US007268796B2

(12) United States Patent
Collins

(10) Patent No.: US 7,268,796 B2
(45) Date of Patent: Sep. 11, 2007

(54) PROCESS AND MECHANISM TO LABEL REMOVABLE MEDIA

(75) Inventor: Mark A. Collins, Dripping Springs, TX (US)

(73) Assignee: Dell Products L.P., Round Rock, TX (US)

( * ) Notice: Subject to any disclaimer, the term of this patent is extended or adjusted under 35 U.S.C. 154(b) by 258 days.

(21) Appl. No.: 11/085,759

(22) Filed: Mar. 21, 2005

(65) Prior Publication Data

US 2006/0209172 A1 Sep. 21, 2006

(51) Int. Cl.
*B41J 2/435* (2006.01)
*B41J 2/47* (2006.01)

(52) U.S. Cl. ..... 347/224; 347/225

(58) Field of Classification Search ..... 347/15, 347/224–225; 365/200; 503/201; 369/275.1–275.2, 369/283

See application file for complete search history.

(56) References Cited

U.S. PATENT DOCUMENTS 5,543,381 A * 8/1996 Kishimoto et al. ..... 503/201
6,154,437 A 11/2000 Utsunomiya et al. .... 369/275.2
6,407,976 B2 6/2002 Nagara et al. ..... 369/116
6,445,669 B1 9/2002 Hattori et al. ..... 369/116
6,469,968 B1 10/2002 Van Den Enden et al. ..... 369/59.12
6,489,265 B1 * 12/2002 Hotta et al. ..... 503/201
6,942,310 B2 * 9/2005 Kanda et al. ..... 347/15
2004/0141385 A1 * 7/2004 Pettigrew et al. ..... 365/200

FOREIGN PATENT DOCUMENTS

JP 05058086 A * 3/1993

* cited by examiner

*Primary Examiner*—Hai Pham
(74) *Attorney, Agent, or Firm*—Hamilton & Terrile, LLP; Stephen A. Terrile

(57) ABSTRACT

A method for writing labels to an optical medium is disclosed. The optical medium includes a label reflecting layer and a label recording layer. The method includes deforming a location within the label recording layer wherein deforming the location within the label recording layer causes a corresponding portion of the label reflecting layer to reflect light at an angle based upon the deforming, and repeating the deforming for a plurality of locations within the label recording layer. The repeated deforming causes a label to be presented on the optical medium.

15 Claims, 5 Drawing Sheets

PROCESS AND MECHANISM TO LABEL REMOVABLE MEDIA

BACKGROUND OF THE INVENTION

1. Field of the Invention

The present invention relates in general to removable media, and more particularly to labeling removable media.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

As information handling systems have become more common and have improved in the speed at which they process information, increasing amounts of information have been generated for storage. Optical media provide a sensible and relatively inexpensive solution for storing large quantities of information on a portable material. Generally, an optical medium stores information by altering the reflective qualities of a data layer material with a focused laser and allows retrieval of information by reflection of the focused laser against the altered material to measure the reflected light characteristics.

Although optical media provide a convenient and portable storage solution, one difficulty faced by users of optical media is tracking the contents on any given optical medium without having to insert the medium in an information handling system to read the contents. To address this difficulty, optical media labeling solutions have emerged that write labels on the non-storage side of an optical medium. With one known method for labeling media, after a user writes information on the storage side of an optical medium, the user turns the optical medium over in the drive to write labels on the non-storage side, such as list of the contents. The labels are written with the optical drive's laser which interacts with chemicals on the non-storage side to make visible markings. With another known method for labeling media, a printer which includes a specialized feeder can print a label onto specialized media which include a surface onto which the label may be printed. With each of these methods, once the label is written onto the media, the label cannot be easily changed.

SUMMARY OF THE INVENTION

In accordance with the present invention, a relatively simple low cost method for providing labels onto media is disclosed in which a reflective material is placed onto the removable media with a malleable substrate contiguous with the reflective material. The substrate can then be heated via a laser beam and thus changes the underlying foundation on which the reflective material is resting. By changing the underlying foundation, the angular shape of the reflective material is changed, thus modifying the light reflected from the reflective material. This method is similar to the operation of a digital light processor (DLP) technology and provides the ability to uniformly reflect varying shades of gray from the surface of the removable media. Additionally, the label is then visible and uniform no matter what the angular field of view to the surface of the removable media. Thus, the label has an appearance similar to that of monochrome pictures that are pressed into the surface of a media. However, because the label is generated by changing the underlying foundation of the media, the label can be easily and repeatably changed (i.e., the label is rewriteable).

More specifically, in one embodiment, the invention relates to a method for writing labels to an optical medium. The optical medium includes a label reflecting layer and a label recording layer. The method includes deforming a location within the label recording layer wherein deforming the location within the label recording layer causes a corresponding portion of the label reflecting layer to reflect light at an angle based upon the deforming, and repeating the deforming for a plurality of locations within the label recording layer. The repeated deforming causes a label to be presented on the optical medium.

In another embodiment, the invention relates to an optical medium which includes a data recording layer, a label recording layer and a label reflective layer operably coupled to the label recording layer such that deforming a certain location within the label recording layer causes a corresponding certain portion of the label reflecting layer to reflect light at an angle based upon the deforming.

In another embodiment, the invention relates to an optical drive for interacting with an optical medium. The optical medium includes a label recording substrate and a reflective material coupled to the label recording substrate. The optical drive includes a label engine and an optical head coupled to the label engine. The label engine causes the optical head to selectively illuminate the label recording substrate of the optical medium. The selective illumination causes the label recording substrate to deform the reflective material to provide a visibly readable effect to present a label on the optical medium.

In another embodiment, the invention relates to an information handling system which includes a processor, a memory coupled to the processor and an optical drive coupled to the processor and the memory. The optical drive interacts with an optical medium. The optical medium includes a label recording substrate and a reflective material coupled to the label recording substrate. The optical drive includes a label engine and an optical head coupled to the label engine. The label engine causes the optical head to selectively illuminate the label recording substrate of the optical medium. The selective illumination causes the label recording substrate to deform the reflective material to provide a visibly readable effect to present a label on the optical medium.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
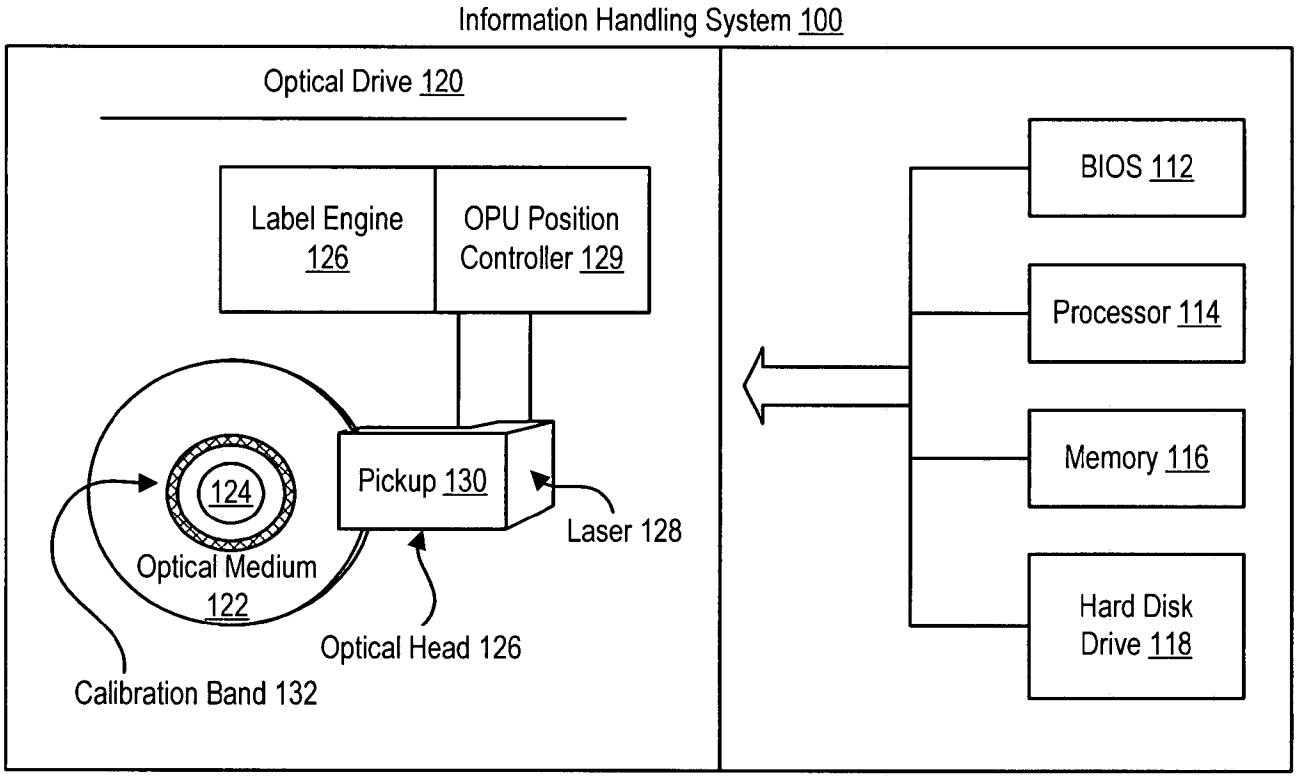
FIG. 1 shows a block diagram of an information handling system having an optical drive that includes rewriteable label functionality.

Referring now to FIG. 1, a block diagram depicts an information handling system 100 having an optical drive that aligns multiple label writes to an optical medium. Processing components of information handling system 100, such as a BIOS 112, CPU 114, RAM 116 and hard disc drive 118, cooperate to generate label information to write a label to an optical medium and to communicate the label information to an optical drive 120.

Optical drive 120 rotates an optical medium 122, such as a CD, DVD or high definition DVD disc, about a spindle 124 and proximate to an optical head 126. Optical head 126 includes a laser 128 that illuminates optical medium 122 and an optical pickup unit 130 that receives illumination reflected from optical medium 122. To write information to optical medium 122, including stored information on a storage surface or label information on a label surface, laser 128 illuminates at higher power settings that alter the material on optical medium 122. Writes of label information to the label surface are performed by a label engine 126 which selectively illuminates laser 128 to alter a substrate contiguous to a reflective label surface to have a visibly-readable effect defined by label information generated by the processing components.

The optical drive 120 provides a dual-function, offering both a read only function and a read/write function. Accordingly, a user can choose which recordable media is best for a particular job.

Figure 2:
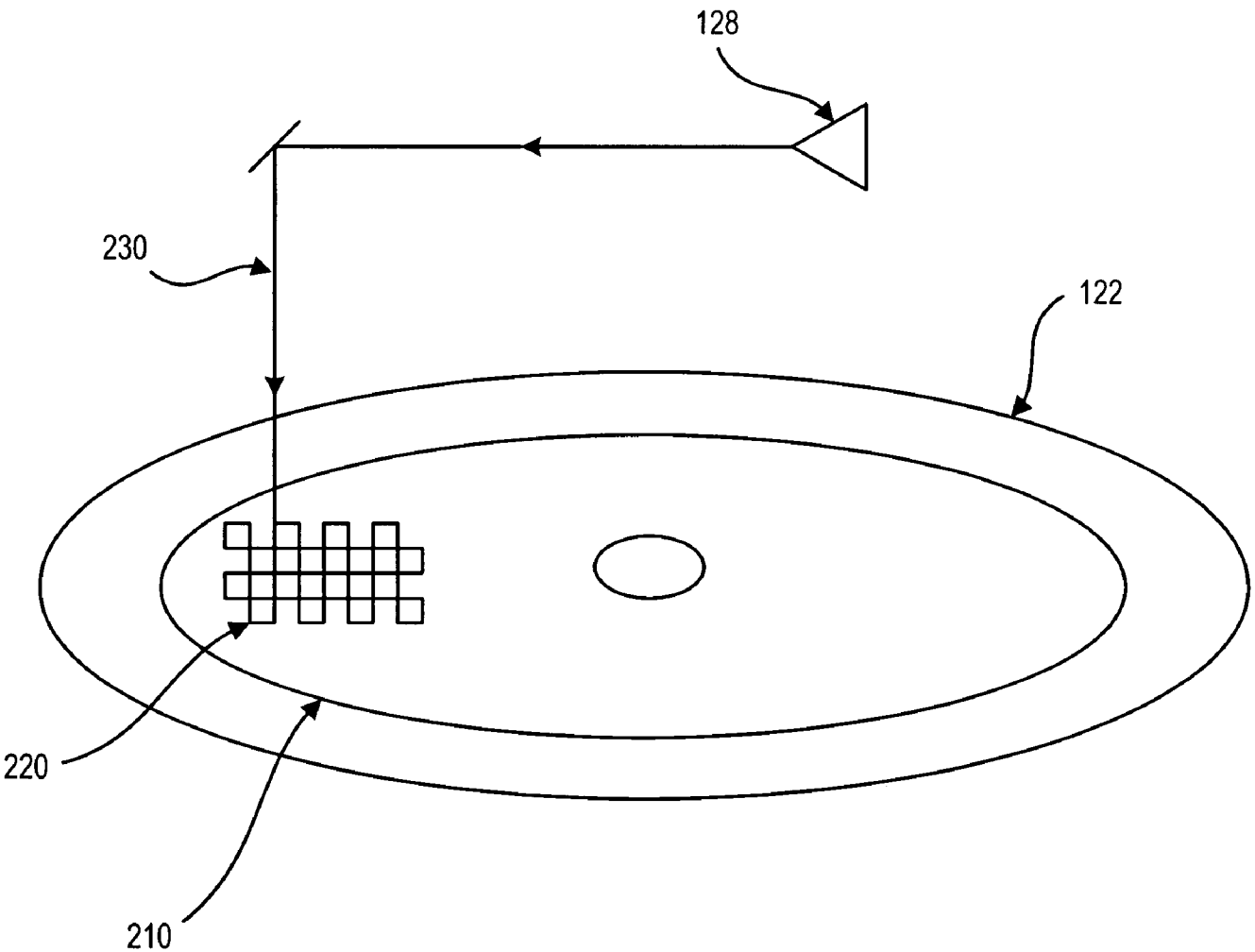
FIG. 2 shows a diagrammatic representation of a laser writing to a label portion of a disk.

Referring to FIG. 2, a diagrammatic representation of a laser writing to a label portion of a disk is shown. More specifically, the optical medium 122 includes a label portion 210. The label portion 210 includes a reflective material (i.e., glitter) which in one embodiment is divided into a plurality of pieces 220. The pieces 220 of reflective material are attached to a malleable substrate (see FIG. 3).

The substrate can then be heated via a laser beam 230 generated by the laser 128 which thus changes the underlying foundation on which the pieces 220 of reflective material is resting. By changing the underlying foundation, the angular shape of each piece 220 of the reflective material is changed, thus modifying the light reflected from the reflective material. Thus, the label portion 210 is visible and uniform no matter what the angular field of view to the surface of the removable media. Because the label is generated by changing the underlying foundation of the media, the label can be easily and repeatably changed (i.e., the label is re-writable).

In one embodiment, the reflective material is a continuous sheet of material that is striated to provide a checkerboard pattern. The checkerboard pattern can have a predetermined density (e.g., either 300 or 600 pieces per inch) so that the label is presented with the predetermined density.

Figure 3:
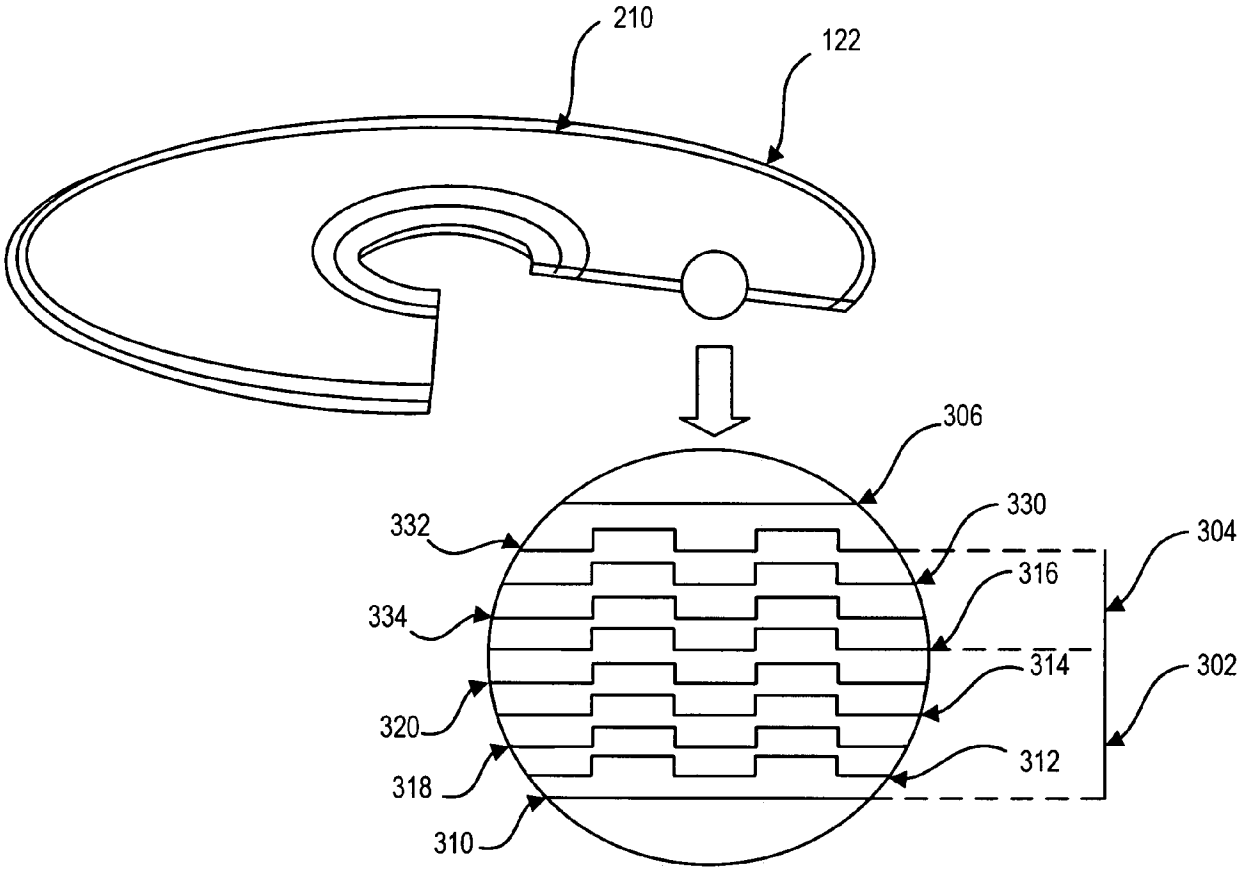
FIG. 3 shows a diagrammatic and cross section of a disk having rewriteable label portion.

Referring to FIG. 3, a diagrammatic and cross section of an optical medium 122 having re-writable label portion is shown. The optical medium 122 includes a plurality of layers as shown by the cross section. The plurality of layers include data layers 302 and label layers 304 as well as a protective layer 306. The data layers 302 include a disc substrate layer 310, a pregroove layer 312, a recording layer 314, and a reflective layer 316 as well as dielectric layers 318, 320. The label layers 304 include a label recording layer 330 and a reflective material layer 332 as well as a dielectric layer 334.

The optical medium 122 uses optical phase change technology to provide rewriteable functionality. In one embodiment, the optical medium 122 provides a phase-change medium which includes, for example, a polycarbonate substrate, molded with a spiral groove for servo guidance, absolute time information and other data, onto which the layers are deposited.

The recording layer 314, which is a phase-change layer, is sandwiched between dielectric layers 318, 320 that draw excess heat from the phase-change layer during the writing process. The label recording layer 330 is contiguous with a dielectric layer 334 that draws excess heat from the label recording layer 330 during the writing process. In one embodiment, the recording layer 314 and the label recording layer 330 are each a crystalline compound made up of a mix of silver, indium, antimony and tellurium. Thus, the recording layer 314 and the label recording layer 330 function so that when the layer is heated to one temperature and cooled the layer becomes crystalline. However, if the layer is heated to a higher temperature, when the layer cools down again it becomes amorphous. With the recording layer 314, the crystalline areas allow the metalised reflective layer 316 to reflect a laser beam better while the non-crystalline portion absorbs the laser beam, so the laser beam is not reflected. With the label recording layer 330, heating the layer causes portions of the layer to deform, which in turn cause the pieces 220 of reflective material included within the reflective layer 332 to reflect light at a different angle than non deformed pieces. Thus by selectively deforming portions of the label recording layer 330, an image is formed on the reflective layer 332.

To achieve these effects in the recording layers, the optical recorder drive 120 use three different laser powers. A highest laser power (i.e., a write power) creates a non-crystalline (absorptive) state on each of the recording layers. A middle power (i.e., an erase power) melts each of the recording layers and converts each of the recording layers to a reflective crystalline state. The lowest power (i.e., a read power) does not alter the state of the recording layer. The recording layer 314 can be used for reading the data. The label recording layer 330 does not use the lowest power of the laser.

During writing, a focused write power laser beam selectively heats areas of the phase-change material above the melting temperature (e.g., above 500-700 C), so that all of the atoms within this area move rapidly in the liquid state. Then, by being cooled sufficiently quickly, the random liquid state is frozen-in to become the amorphous state obtained. The amorphous version of the material shrinks, leaving a pit where a laser dot was written, resulting in a recognizable surface. With the label recording layer 330, the pit thus causes a change in the angle of the piece of reflective material corresponding to where the pit was generated.

When an erase power laser beam heats the phase-change layer to below the melting temperature but above the crystallization temperature (e.g., about 200 C) for a sufficient time (at least longer than the minimum crystallization time), the atoms revert back to an ordered state (i.e. the crystalline state).

Writing to the recording layer 314 of the optical medium occurs during a single pass of the focused laser beam 230. This writing is sometimes referred to as direct overwriting and the process can be repeated several thousand times per disc.

Once the data has been burned, the amorphous areas of the optical medium 122 reflect less light, enabling a read power laser beam to detect the difference between the lands and the pits on the disk.

The label engine 126 controls which pieces of the label recording layer 330 are deformed to cause a desired image to be presented via the label portion 210.

Figure 4:
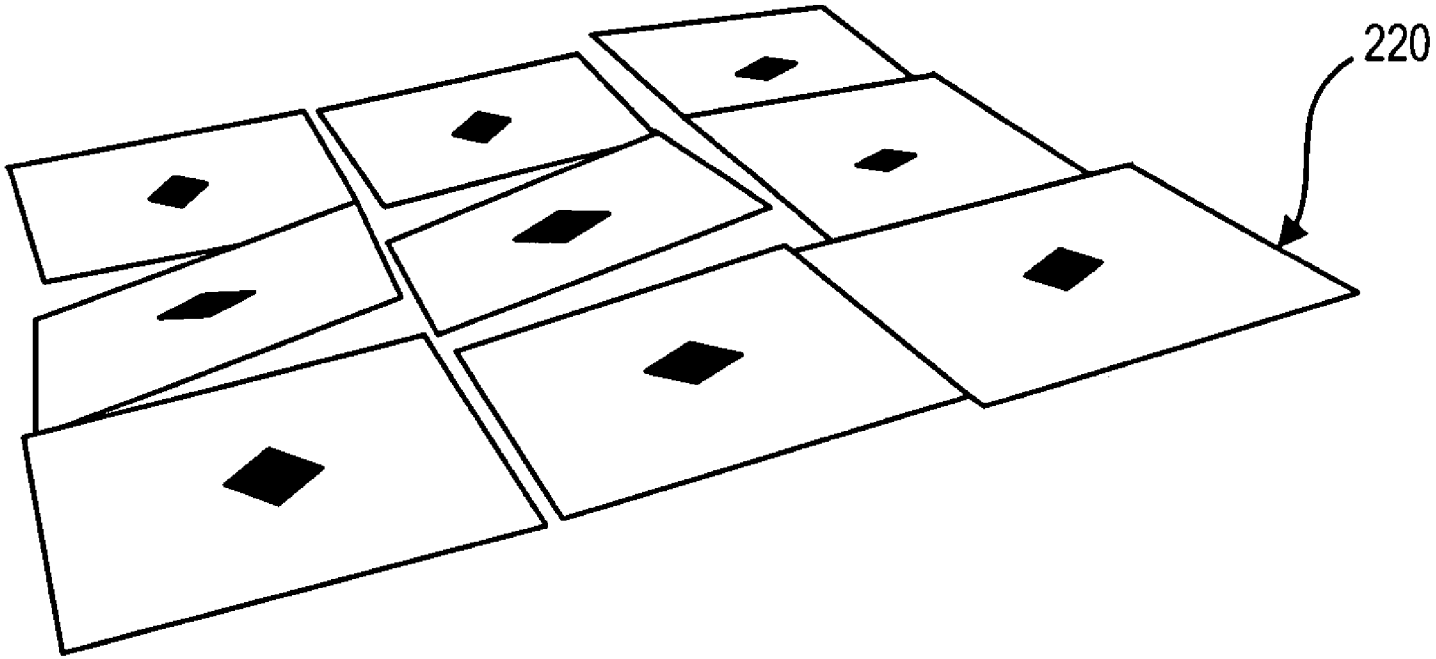
FIG. 4 shows a perspective view of a portion of the rewriteable label portion of a disk.

FIG. 4 shows a perspective view of a portion of the re-writable label portion of a disk. More specifically, the pieces 220 of reflective material can be arranged in any desired density. For example, in one embodiment, the pieces 220 can have a density of 300 pieces per inch, thus enabling presenting an image of 300 dots per inch. By controlling where the underlying recording layer is deformed, the pieces 220 can vary the angle of deflection. Varying the angle of deflection can thus present an image as a varying gray scale.

The present invention is well adapted to attain the advantages mentioned as well as others inherent therein. While the present invention has been depicted, described, and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The depicted and described embodiments are examples only, and are not exhaustive of the scope of the invention.

For example, the above-discussed embodiments include software modules that perform certain tasks. The software modules discussed herein may include script, batch, or other executable files. The software modules may be stored on a machine-readable or computer-readable storage medium such as a disk drive. Storage devices used for storing software modules in accordance with an embodiment of the invention may be magnetic floppy disks, hard disks, or optical discs such as CD-ROMs or CD-Rs, for example. A storage device used for storing firmware or hardware modules in accordance with an embodiment of the invention may also include a semiconductor-based memory, which may be permanently, removably or remotely coupled to a microprocessor/memory system. Thus, the modules may be stored within a computer system memory to configure the computer system to perform the functions of the module. Other new and various types of computer-readable storage media may be used to store the modules discussed herein. Additionally, those skilled in the art will recognize that the separation of functionality into modules is for illustrative purposes. Alternative embodiments may merge the functionality of multiple modules into a single module or may impose an alternate decomposition of functionality of modules. For example, a software module for calling sub-modules may be decomposed so that each sub-module performs its function and passes control directly to another sub-module.

Figure 5:
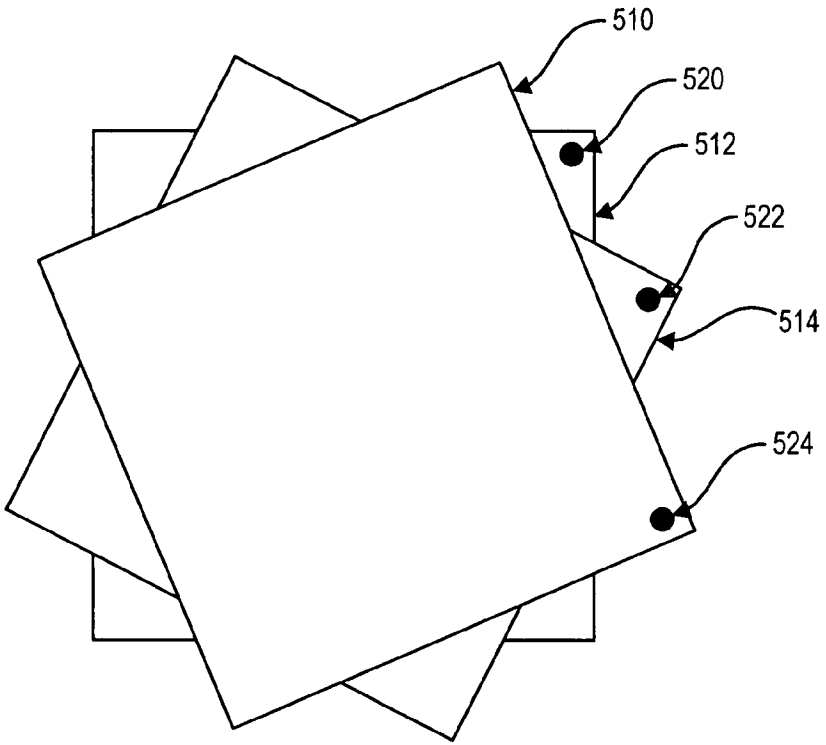
FIG. 5 shows a top view of a single set of reflective material for providing color rewriteable label functionality.

Also for example, referring to FIG. 5, a top view of a single location of reflective material for providing color rewritable label functionality is shown. In this embodiment, the reflective layer 332 includes a plurality of dichroic filter pieces 510, 512, 514 located over a reflective layer and operably interconnected with the label recording layer 330. The dichroic filter pieces 510, 512, 514 would correspond to different colors, such as RGB, so that different combinations of the filters cause different colors to be presented. Each piece 510, 512, 514 includes a respective location 520, 522, 524 where the laser beam is aimed to cause the angle of a particular piece to change. Adjusting the angles by which each of the pieces are changed enables a color to be presented at that location.

Consequently, the invention is intended to be limited only by the spirit and scope of the appended claims, giving full cognizance to equivalents in all respects.

What is claimed is:

1. A method for writing labels to an optical medium, the optical medium including a label reflecting layer and a label recording layer, the method comprising:

deforming a location within the label recording layer, the deforming the location within the label recording layer causing a corresponding portion of the label reflecting layer to reflect light at an angle based upon the deforming, the label reflecting layer comprising a continuous sheet of reflective material, the continuous sheet of reflective material being striated to provide a checkerboard pattern;

repeating the deforming for a plurality of locations within the label recording layer, the repeating the deforming causing a label to be presented on the optical medium.

2. The method of claim 1 wherein:

the plurality of locations are arranged with a predetermined density, the predetermined density enabling the label to be presented with the predetermined density.

3. The method of claim 1 wherein:

the reflective layer includes a plurality of dichroic filters, light being reflected through the dichroic filters to present a color label.

4. The method of claim 3 wherein:

locations within the label recording layer are deformed to cause light to pass through the dichroic filters angles based upon the deforming.

5. An optical medium comprising:

a data recording layer;

a label recording layer;

a label reflective layer operably coupled to the label recording layer such that deforming a certain location within the label recording layer causes a corresponding certain portion of the label reflecting layer to reflect light at an angle based upon the deforming, the label reflecting layer comprising a continuous sheet of reflective material, the continuous sheet of reflective material being striated to provide a checkerboard pattern.

6. The optical medium of claim 5 wherein:

the label reflective layer includes a plurality of locations arranged with a predetermined density, the predetermined density enabling a label to be presented on the optical medium with the predetermined density.

7. The optical medium of claim 5 wherein:

the reflective layer includes a plurality of dichroic filters, light being reflected through the dichroic filters to present a color label.

8. The optical medium of claim 7 wherein:

locations within the label recording layer are deformed to cause light to pass through the dichroic filters angles based upon the deforming.

9. An optical drive for interacting with an optical medium, the optical medium including a label recording substrate and a reflective material coupled to the label recording substrate, the optical drive comprising:

a label engine;

an optical head coupled to the label engine, the label engine causing the optical head to selectively illuminate the label recording substrate of the optical medium, the selectively illuminating causing the label recording substrate to deforms, deformation of the label recording substrate causing the reflective material to provide a visibly readable effect to present a label on the optical medium, the reflective material being arranged in a checkerboard pattern.

10. The optical drive of claim 9 wherein:

the reflective material includes a plurality of locations arranged with a predetermined density, the predetermined density enabling a label to be presented on the optical medium with the predetermined density.

11. The optical drive of claim 9 wherein:

the reflective material includes a continuous sheet of reflective material.

12. The optical drive of claim 11 wherein:

the optical head selectively illuminates the label recording substrate in locations to cause locations within the checkerboard pattern to provide the visibly readable effect.

13. The optical drive of claim 9 wherein:

the optical medium further includes a plurality of dichroic filters, light being reflected through the dichroic filters to present a color label.

14. The optical drive of claim 13 wherein:

locations within the label recording substrate are deformed to cause light to pass through the dichroic filters angles based upon the deforming.

15. An information handling system comprising:

a processor;

a memory coupled to the processor, the memory and the processor cooperating to generate label information;

an optical drive coupled to the processor and the memory, the optical drive interacting with an optical medium, the optical medium including a label recording substrate and a reflective material coupled to the label recording substrate, the optical drive including a label engine;

an optical head coupled to the label engine, the label engine causing the optical head to selectively illuminate the label recording substrate of the optical medium, the selectively illuminating causing the label recording substrate to deform, deformation of the label recording substrate causing the reflective material to provide a visibly readable effect to present a label based upon the label information on the optical medium, the reflective material being arranged in a checkerboard pattern.

* * * * *